US008931190B2

(12) United States Patent
Knight

(10) Patent No.: US 8,931,190 B2
(45) Date of Patent: Jan. 13, 2015

(54) EXCAVATOR FASTENER

(71) Applicant: Garrett D. Knight, Kincardine (CA)

(72) Inventor: Garrett D. Knight, Kincardine (CA)

(73) Assignee: Raptor Mining Products Inc.

( * ) Notice: Subject to any disclaimer, the term of this patent is extended or adjusted under 35 U.S.C. 154(b) by 110 days.

(21) Appl. No.: 13/986,131

(22) Filed: Apr. 4, 2013

(65) Prior Publication Data

US 2013/0269223 A1 Oct. 17, 2013

Related U.S. Application Data

(60) Provisional application No. 61/686,846, filed on Apr. 13, 2012.

(51) Int. Cl.
*E02F 9/28* (2006.01)
*E02F 3/36* (2006.01)

(52) U.S. Cl.
CPC ..... *E02F 3/3686* (2013.01); *E02F 9/2825* (2013.01); *E02F 9/2833* (2013.01)
USPC ..... 37/455

(58) Field of Classification Search
USPC ..... 37/452–459; 172/772, 772.5
See application file for complete search history.

(56) References Cited

U.S. PATENT DOCUMENTS

| | | | | |
|---|---|---|---|---|
| 3,413,739 | A * | 12/1968 | Guinot | 37/455 |
| 4,433,496 | A * | 2/1984 | Jones et al. | 37/456 |
| 5,937,550 | A * | 8/1999 | Emrich | 37/458 |
| 7,313,877 | B2 * | 1/2008 | Clendenning et al. | 37/456 |
| 7,603,799 | B2 * | 10/2009 | Campomanes | 37/456 |
| 7,681,341 | B2 * | 3/2010 | Ruvang | 37/456 |
| 2007/0261278 | A1 * | 11/2007 | Campomanes | 37/452 |
| 2009/0205228 | A1 * | 8/2009 | Ruvang | 37/456 |
| 2010/0162595 | A1 * | 7/2010 | Leslie et al. | 37/456 |
| 2014/0013635 | A1 * | 1/2014 | Cui | 37/456 |

* cited by examiner

*Primary Examiner* — Matthew D Troutman

(57) ABSTRACT

A fastener for securing a tooth adapter to the bucket or other piece of earth moving equipment which provides for mechanical advantage whereby tightening of one portion, procures a multiplication of force, for providing secure engagement.

7 Claims, 7 Drawing Sheets

EXCAVATOR FASTENER

FIELD OF THE INVENTION

This application is based on U.S. Provisional Application No. 61/686,846 filed Apr. 13, 2013, the priority of which is claimed.

The invention relates to earth moving equipment such as excavators, and in particular to a fastener for securing excavator tooth components together.

BACKGROUND OF THE INVENTION

Earth moving equipment such as excavators usually have teeth secured to a device, for example a bucket. As the teeth wear they are replaced.

For this purpose releasable fastening devices are provided for securing the teeth to the bucket. The teeth themselves are usually supported on tooth adapters, and the tooth adapters are themselves secured to the bucket. The teeth are themselves subject to wear and replacement, at regular intervals. However the tooth adapters on which the teeth are mounted also wear and require replacement.

BRIEF SUMMARY OF THE INVENTION

The invention provides a fastener for securing the tooth adapters to the bucket or other piece of earth moving equipment.

The bucket has a series of fixed bosses, along a leading edge, to which respective tooth adapters are attached. The adapter has a through opening , and the boss has a corresponding through opening. The fastener fits through the opening in the boss. A cam head is attached to the fastener, and the fastener incorporates drive means for rotating the cam head. The cam head engages the interior of the through opening in the tooth adapter, drawing it firmly back onto the boss, and holds it securely on the boss.

The drive means includes, in one embodiment, a pair of complementary helical drive surfaces, and a screw threaded drive bolt. Operation of the bolt draws the two helical drive surfaces together, and this rotates the cam head, in a gradual progressive manner.

In this way several rotations of the bolt can be made to provide for a one half rotation of the cam head, thus giving what is in effect a mechanical advantage, for rotating the cam head.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

DESCRIPTION OF PREFERRED EMBODIMENT

Figure 1:
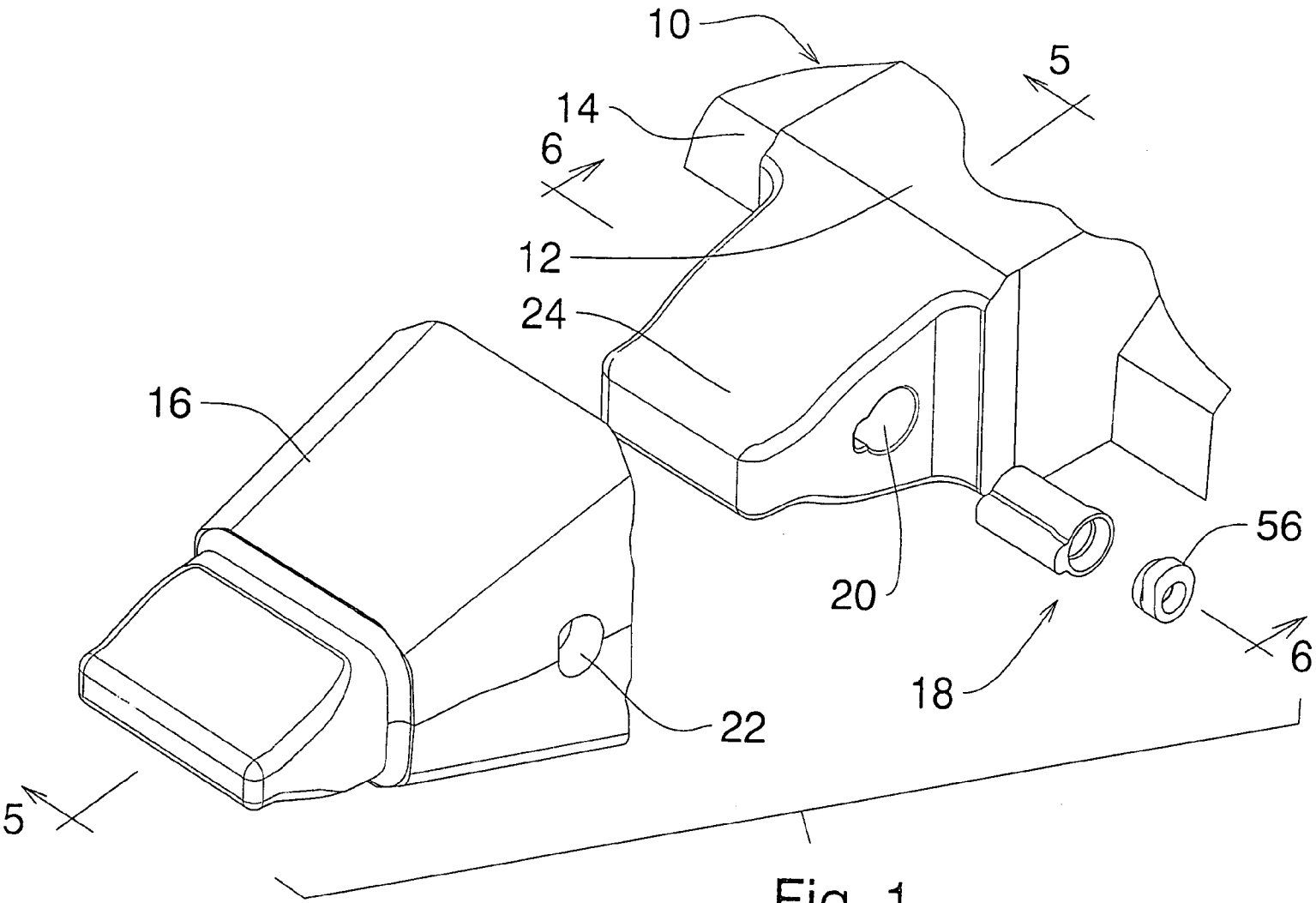
FIG. 1 is a perspective of a tooth adapter and a boss, partly exploded.
Figure 2:
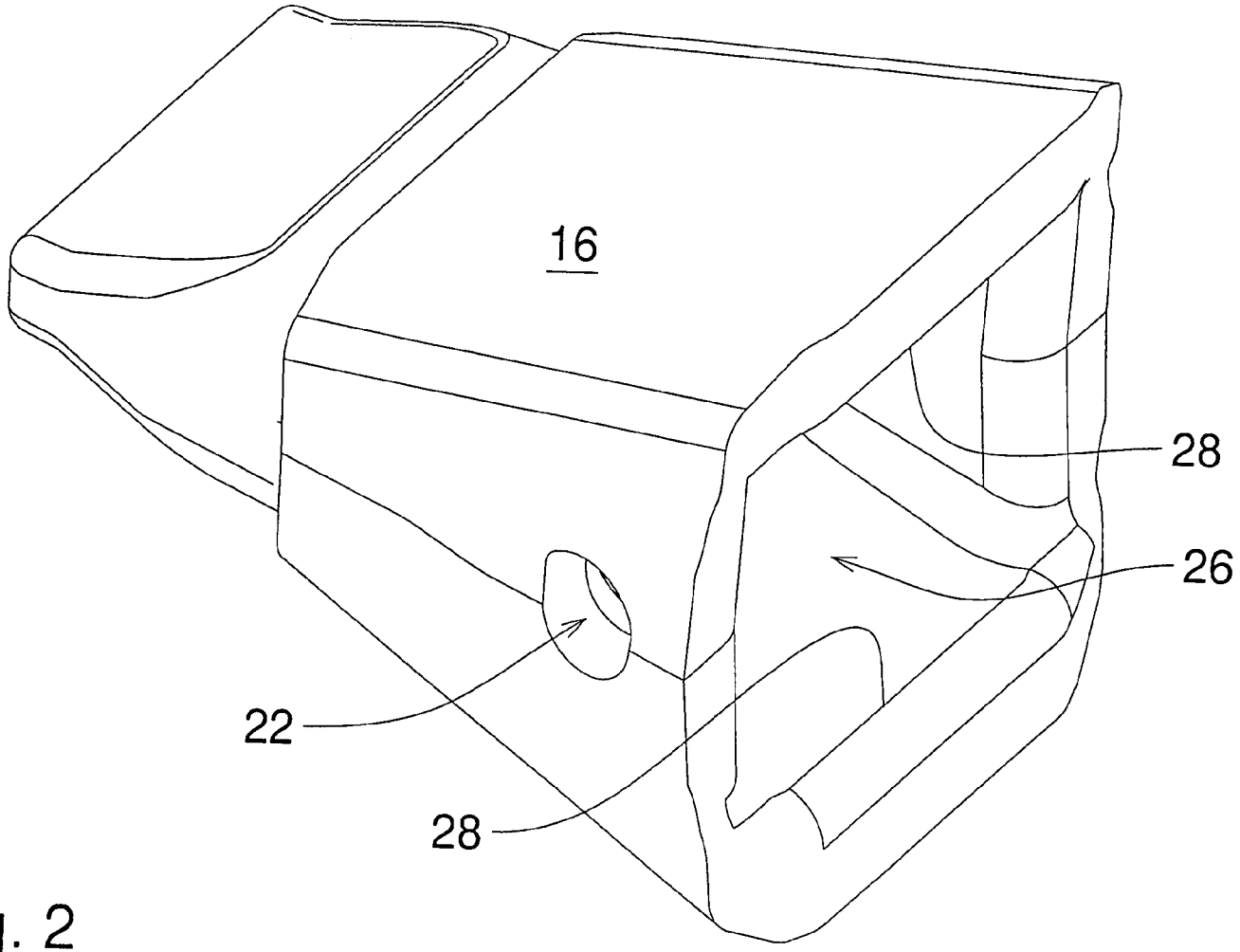
FIG. 2 is a perspective of a tooth adapter.
Figure 3:
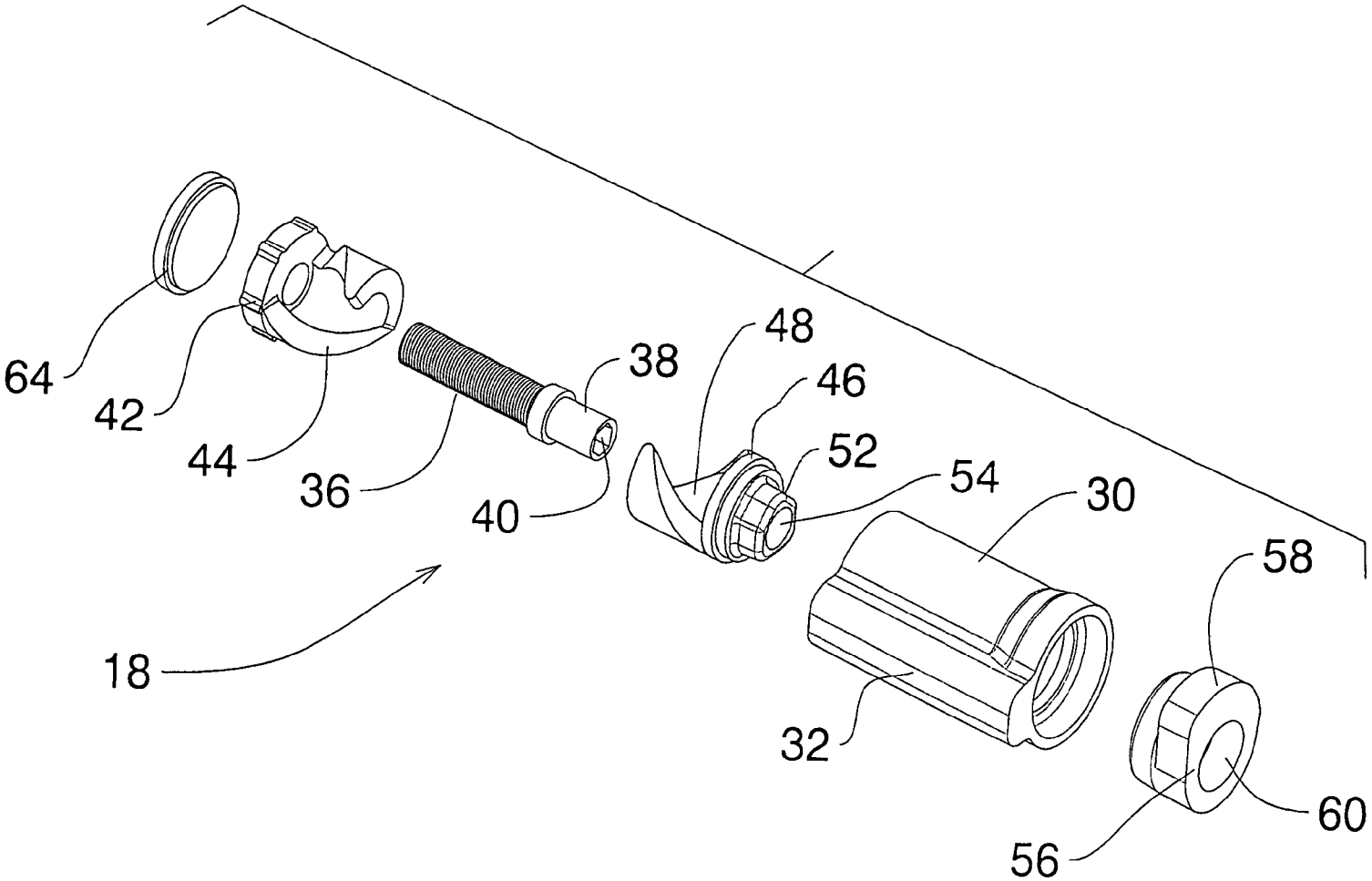
FIG. 3 is an exploded perspective of the fastener.

FIG. 1 shows part of a bucket at (10). A boss (12) is shown welded to the bucket edge (14).

A tooth adapter (16) is shown separated from the boss.

The actual excavator tooth itself is not shown, but would normally make a friction fit on adapter (16). Such teeth and adapters are know per se, and require no special description.

The invention is directed to a fastener (18) for securing the tooth adapter (16) on the boss (12).

Such fastener should preferably be able to be adjusted and tightened so that it provides a considerable force acting between the boss and the tooth adapter, drawing the two components firmly towards one another. Such force should preferably be applied through a system having a great mechanical advantage.

The boss (12) has a through opening (20) of known size, extending transversely.

The tooth adapter (16) has a through opening (22) extending transversely; and of a size corresponding to the opening (20). The shapes of the two openings are slightly different, to accommodate parts of the fastener.

The boss (12) has tapered wedging surfaces (24), and the tooth adapter (16) has an interior cavity (26) defining corresponding interior wedging surfaces (28).

The fastener (18) has an exterior sleeve body (30), of generally cylindrical shape, formed with a lengthwise abutment (32), and having a hollow interior.

The boss opening (20) is formed with a recess (34) to receive the abutment (32).

Within the interior of sleeve body (30) a threaded bolt (36) is located having a head (38) with a hex recess (40)

A helical drive member (42) is threaded on bolt (36) and has a helical drive surface (44).

A helical driven member (46) is located around bolt (36), and has helical driven surface (48) complimentary to helical drive surface (44).

Driven member (46) is not threaded, and the bolt (36) can rotate freely within it.

Driven member (46) has a head (50) formed on its end; having non-circular ie. angled head surfaces (52), typically a pentagon. Head (50) has an axial through opening (54), giving access to head (38) of bolt (36).

Figure 4:
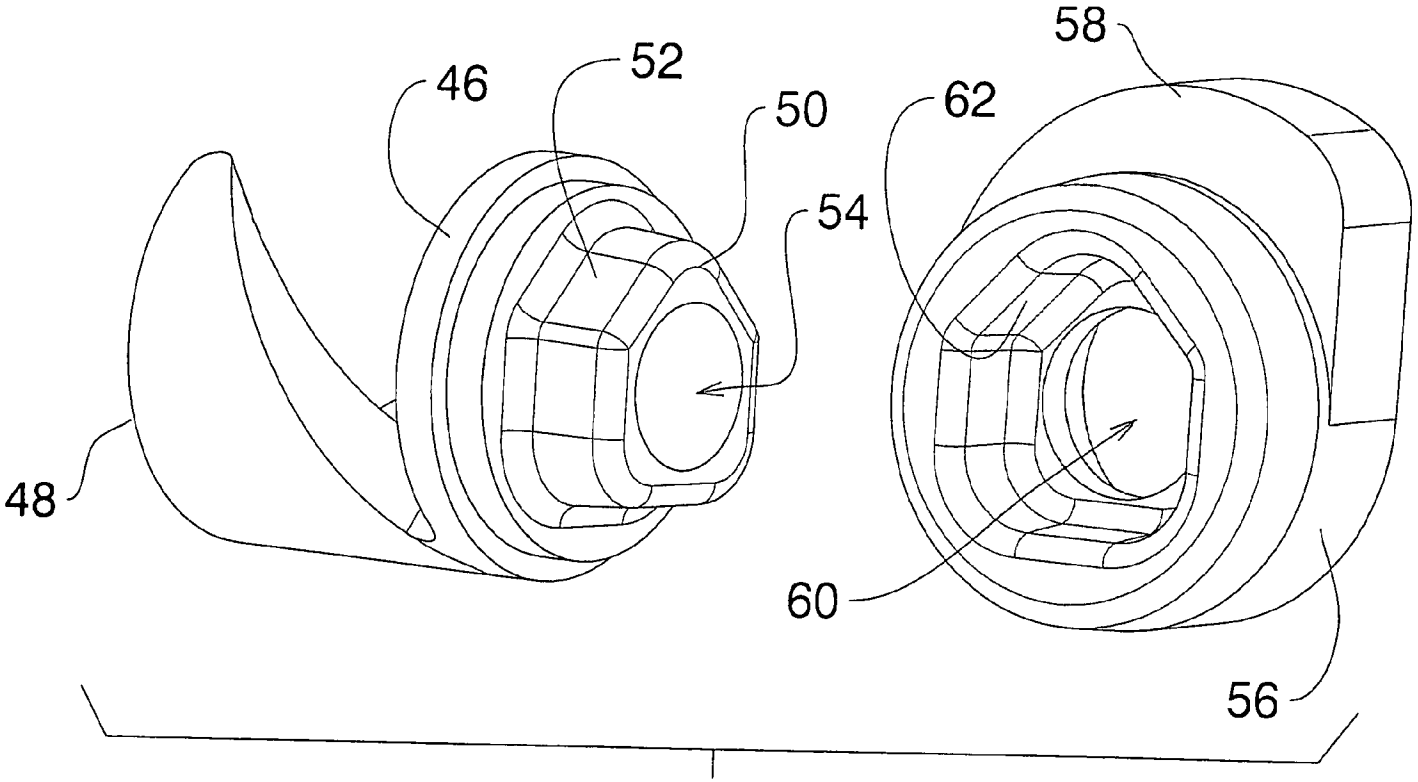
FIG. 4 is an exploded view of the driven member and the cam, of the fastener.
Figure 5:
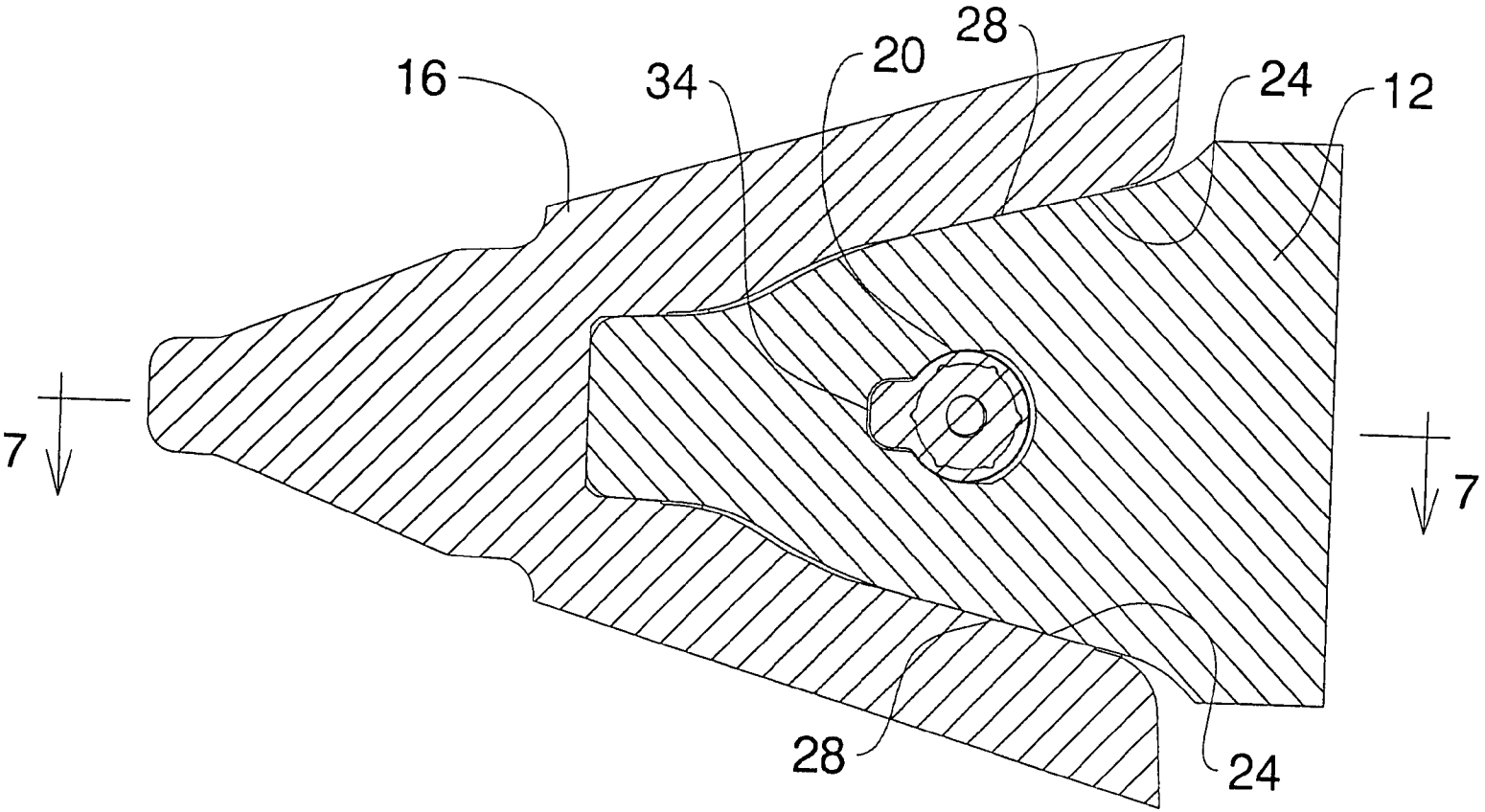
FIG. 5 is a section along line 5-5 of FIG. 1.
Figure 6:
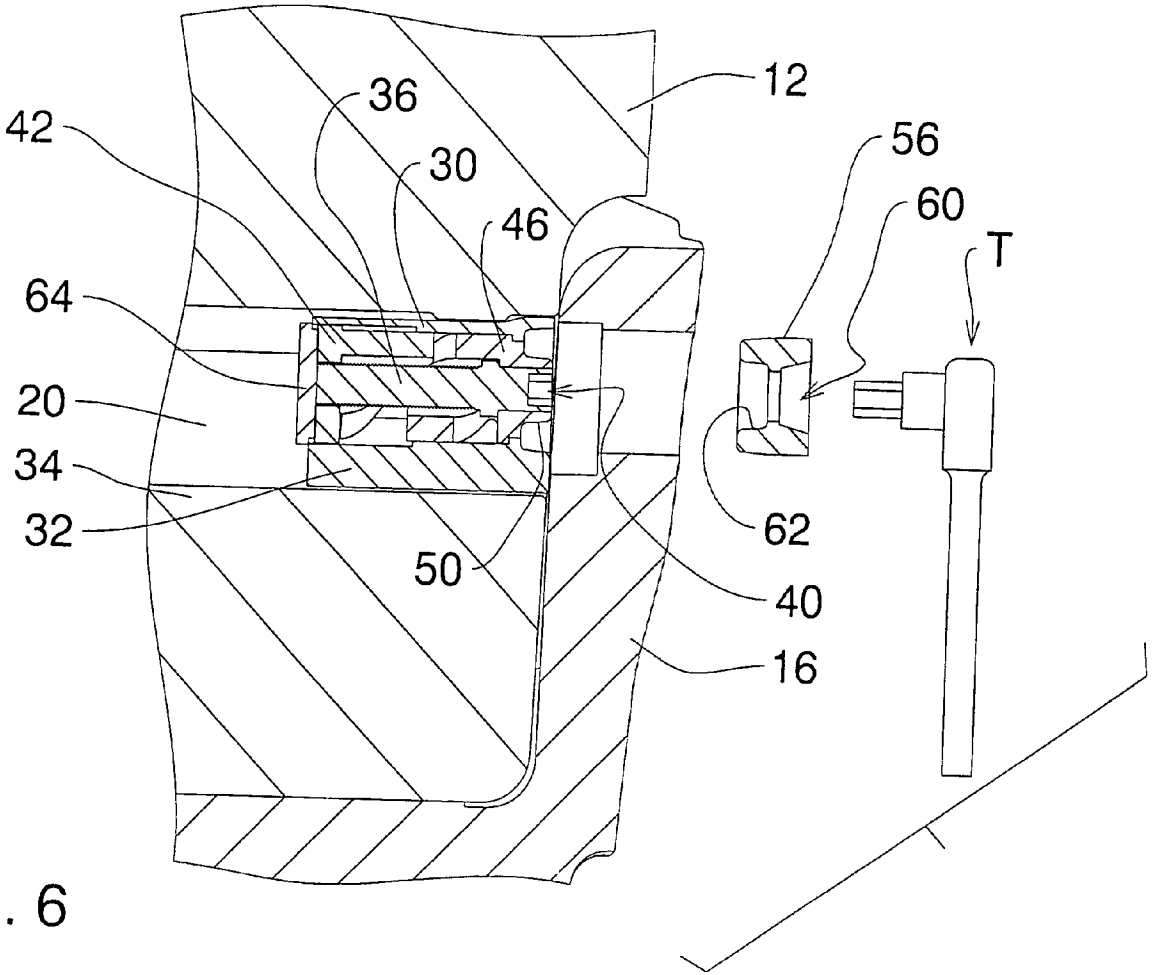
FIG. 6 is a section partly exploded, along line 6-6 of FIG. 1.
Figure 7:
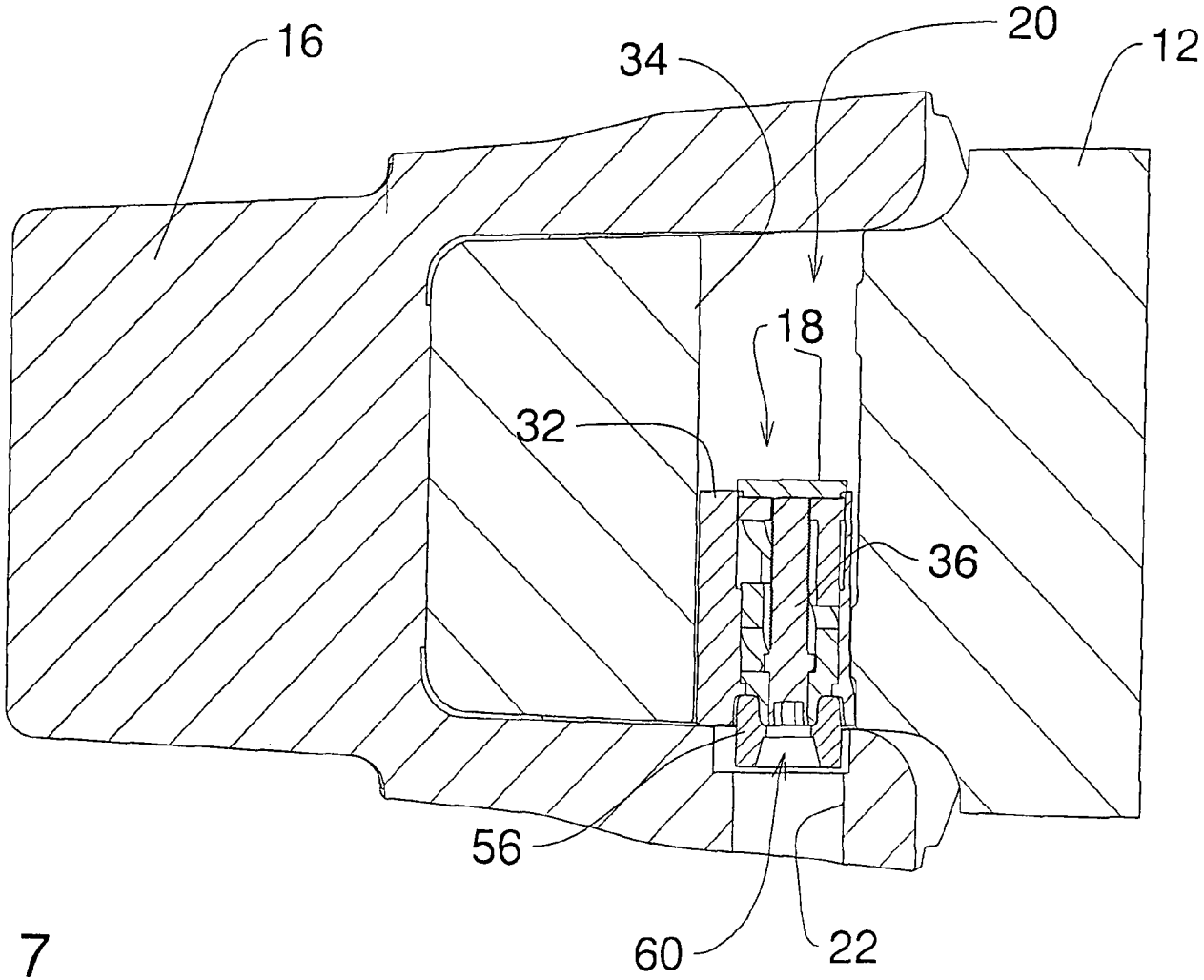
FIG. 7 is a section along line 7-7 of FIG. 2.

A pressure cam (56) has a cam lobe (58) and a through opening (60). On its inner end cam (56) has non-circular ie. angled driven surfaces (62) (FIG. 4) matching angled head surfaces (52) of head (50), on which cam (56) makes a sliding fit. The angled drive surfaces could also be any non-circular shape such as oval. All such surfaces are herein defined as non-circular.

An end cap (64) closes the inner end of sleeve (30).

In use, the fastener (18), without the cam (56), is placed in opening (20) of boss (12), with abutment (32) received in recess (34).

The tooth adapter (16) is then slid over boss (12). The cam (56) is then placed on the angled head surfaces (52) of head (50). A tool T such as a hex drive, or allen key is then inserted, though cam (56) and into drive recess (40), of bolt (36).

The bolt is then rotated, drawing the helical surface (44) of drive member (42) towards the helical driven surface (48) of driven member (46).

As the two engage, the driven member (46) will be slowly rotated thus rotating head (50). Cam (56) will thus rotate in unison with driven member (46). Lobe (58) of cam (56) will then engage the tooth adapter (16) within opening (22), and draw it firmly against boss (12)

By selecting suitable bolt threading, and suitable angles on the helical surfaces (44) and (48), it is possible to provide a mechanical advantage of 5 or 6 or 7 to 1. This will be sufficient to hold tooth adapter (16) firmly on boss (12)

Other forms of drive reduction could be provided, such as internal gears, wedges, or two threaded members with different thread ratios.

The foregoing is a description of a preferred embodiment of the invention which is given here by way of example only. The invention is not to be taken as limited to any of the specific features as described, but comprehends all such variations thereof as come within its scope.

What is claimed is:

1. A fastener for securing a tooth adapter to a bucket of an earth moving apparatus; and, wherein a plurality of bosses are secured to the bucket, for receiving respective tooth adapters, said bosses defining a longitudinal axis, and a transverse through opening, and said tooth adapters each having a through opening and comprising;

a fastener body shaped to fit through the transverse through opening in the boss, and having a hollow interior ;

a threaded bolt within said hollow interior of the fastener body;

a drive member in said fastener body with a threaded interior threaded on said bolt;

a driven member in said fastener body having a non threaded interior freely surrounding said bolt, separate from said drive member, and said driven member being rotatable in response to engagement with said drive member, said bolt being operable to draw said drive member into engagement with said driven member together, and thus rotate said driven member; and a cam attachable to said driven member on the bolt; and being rotatable in unison with rotation of said driven member.

2. A fastener as claimed in claim 1 wherein said drive member and said driven member are of generally cylindrical shape.

3. A fastener as claimed in claim 2 wherein the drive member includes a helical drive surface, and wherein said driven member includes a helical driven surface, the two surfaces being complimentary, and said drive surface and said driven surface being engageable with each other upon operation of said bolt, to cause rotation of said driven member as aforesaid.

4. A fastener as claimed in claim 3 wherein said driven member defines a head with a non-circular head surface, and wherein said cam defines interior non-circular surfaces complimentary to said non-circular head surface, said cam being slideably engageable with said non-circular head surfaces.

5. A fastener as claimed in claim 4 wherein said cam defines a through opening, registering with said bolt, providing access to said bolt.

6. A fastener as claimed in claim 5 wherein said transverse through opening in said boss defines an abutment recess, and wherein said fastener body defines an abutment complimentary to said abutment recess, thereby preventing rotation of said fastener body within said boss.

7. A fastener as claimed in claim 4 wherein said non-circular surfaces are angular.

* * * * *